US005381910A

United States Patent [19]

Sugiura et al.

[11] Patent Number: 5,381,910

[45] Date of Patent: Jan. 17, 1995

[54] SYNTHETIC RESIN BOTTLE-SHAPED CONTAINER

[75] Inventors: Hiroaki Sugiura, Tokyo; Toshio Yaka, Shiga, both of Japan

[73] Assignee: Yoshino Kogysho Co., Ltd., Tokyo, Japan

[21] Appl. No.: 655,378

[22] PCT Filed: Jul. 10, 1990

[86] PCT Pat. No. PCT/JP90/00883

§ 371 Date: Jul. 10, 1990

§ 102(e) Date: Jul. 10, 1990

[87] PCT Pat. No. W091/00829

PCT Pub. Date: Jan. 24, 1991

[51] Int. Cl.[6] ..... B65D 1/02

[52] U.S. Cl. ..... 215/1 C; 220/669; 220/675

[58] Field of Search ..... 220/669, 671, 675; 215/1 C, 100 A; D9/523, 538, 539, 541, 555, 546

[56] References Cited

U.S. PATENT DOCUMENTS

| | | | |
|---|---|---|---|
| D. 93,193 | 8/1934 | Laufer | D9/541 |
| D. 179,020 | 10/1956 | Markus | D9/546 |
| D. 191,641 | 10/1961 | Du Pree | D9/541 |
| D. 294,463 | 3/1988 | Lang | D9/557 X |
| D. 295,375 | 4/1988 | Lang | D9/434 |
| D. 308,482 | 6/1990 | Wild | D9/557 X |
| D. 315,869 | 4/1991 | Collette | D9/538 X |
| D. 316,967 | 5/1991 | York | D9/538 |
| 3,448,775 | 6/1969 | Lembach et al. | 220/669 X |
| 3,536,223 | 10/1970 | Muhlhoff et al. | D9/539 X |
| 3,537,498 | 11/1970 | St. Amand | 220/771 X |
| 3,708,082 | 1/1973 | Platte | 215/100 A X |
| 4,155,474 | 5/1979 | Bizzarri | D9/523 X |
| 4,497,855 | 2/1985 | Agrawal et al. | 215/1 C X |
| 4,610,366 | 9/1986 | Estes et al. | 220/675 X |
| 4,749,092 | 6/1988 | Sugiura et al. | 215/1 C |
| 4,804,097 | 2/1989 | Alberghini et al. | 215/1 C X |
| 4,805,788 | 2/1989 | Akiho | 215/1 C |
| 4,818,575 | 4/1989 | Hirata et al. | 215/1 C X |
| 4,863,046 | 9/1989 | Collette et al. | 215/1 C |
| 4,877,141 | 10/1989 | Hayashi et al. | 215/1 C |
| 4,890,752 | 1/1990 | Ota et al. | 215/1 C |
| 4,946,053 | 8/1990 | Conrad | 215/100 A X |
| 4,993,565 | 2/1991 | Ota et al. | 215/100 A X |

FOREIGN PATENT DOCUMENTS

| | | | |
|---|---|---|---|
| 55595 | 7/1982 | European Pat. Off. | 215/1 C |
| 1326132 | 3/1963 | France | 215/1 C |
| 60-38208 | 3/1985 | Japan . | |
| 60-175016 | 11/1985 | Japan . | |
| 62-60507 | 4/1987 | Japan . | |
| 64-9146 | 1/1989 | Japan . | |
| 64-4662 | 2/1989 | Japan . | |
| 2025889 | 1/1980 | United Kingdom | 215/1 C |

*Primary Examiner*—Sue A. Weaver

*Attorney, Agent, or Firm*—Oliff & Berridge

[57] ABSTRACT

A biaxially oriented blow-molded bottle-shaped container made of synthetic resin comprises a rectangular tubular body provided with a generally central circumferential groove having upper and lower sidewalls. The sidewalls are inclined at an oblique angle within a range of 21°–28° with respect to a vertical longitudinal axis of the container. The rectangular tubular body includes flat walls, each having a central recessed portion with a bottom wall comprising a shaped panel wall for compensating for deformation due to reduced pressure in the container and a shaped peripheral groove invertedly curved around the shaped panel wall. The shaped panel wall has ribs traversing the shaped panel wall parallel to each other, and a crest of each of the ribs has a larger radius of curvature than that of a root thereof. The rectangular tubular body has an upper end which is a regular polygon having twice as many corners as corner panels of a main portion of the body and a shoulder having a lower end portion connected to the upper end of the body. The lower end portion of the shoulder is in the form of a regular polygonal truncated pyramid shape.

23 Claims, 7 Drawing Sheets

SYNTHETIC RESIN BOTTLE-SHAPED CONTAINER

BACKGROUND OF THE INVENTION

1. Field of the Invention

The present invention relates to a large bottle made of synthetic resin, and, more particularly, relates to the body wall structure of a large square bottle made of biaxially oriented blow molded polyethylene terephthalate (hereinafter referred to as "PET"). The structure of the bottle including the body upper end to a shoulder and the wall structure of a ridge-line portion provides a significant influence upon the external appearance and configuration of the bottle by bending and connecting two wall surface portions.

2. Description of Related Art

The biaxial oriented blow molded bottle of polyethylene terephthalate resin has excellent durability in various areas such as content resistance, chemical resistance, weather resistance, shock resistance and the like. Such a bottle also exhibits high mechanical strength, transparency, no pollution and gas barrier properties. Therefore, this type of bottle has been used on a large scale for containing various kinds of liquid.

However, the PET biaxial oriented blow molded large bottle does not have sufficient mechanical strength in its body, such as self configuration sustaining capability or buckling strength, since the body is a main portion of the bottle and is thin in thickness. Particularly, a bottle having a square tubular body is poor in not only buckling strength but also self configuration sustaining capability. Therefore, large depressed deformations tend to occur in the body which are caused by negative pressure generated within the bottle after a liquid is contained and sealed therein.

In order to solve such problems in a square-shaped PET bottle, a central circumferential groove is provided at a substantial center of the body for increasing buckling strength against depression force applied on the bottle from the outside and for increasing self configuration sustaining capability of the body against external forces applied in the diametrical direction. At the central portion of a flat wall on the body, divided into upper and lower portions by a central circumferential groove, a recessed portion is provided having a depression deformable shaped panel wall as a bottom wall for taking up negative pressure generated in the bottle by a certain depression deformation at the shaped panel wall to prevent any depression deformation from occurring in the body and to increase self configuration sustaining capability of the flat wall portion.

An increase in mechanical configuration sustaining capability by providing a central circumferential groove and a recessed portion formed with the shaped panel wall can be obtained by adding inclined groove sidewalls in the central circumferential groove and inclined groove sidewalls in the recessed portion as reinforcing rib wall pieces with respect to the diametrical direction of the body.

Therefore, hitherto, in order to increase the function of inclined groove sidewalls and recess sidewalls of the central circumferential groove and the recessed portion as reinforcing rib wall pieces, oblique angles of the groove sidewalls and recessed sidewalls with respect to the central axis of the bottle have been set to large values.

The self configuration sustaining capability of the body of the bottle, particularly the vicinity of the central circumferential groove grasped by the hand is actively reinforced by setting the oblique angles of the grooved sidewalls and recessed sidewalls at large values. However, when more than a certain pressure is applied to the body of the bottle at the time of handling or at the time of casing and transporting bottles, the wall portion extending from the groove sidewalls and recessed sidewalls to the flat wall is sharply bent and/or depressedly deformed. Further, the deformed portion will not return to the original configuration even if the pressure is removed, and the bent and/or depressed deformation then becomes a permanent deformation which causes the commercial value of the bottle to be lost.

The above-described conventional negative pressure accommodating recessed portion is constructed by forming the shaped panel wall with a bottom wall having a shape which is easily deformable by negative pressure and absorbing negative pressure generated in the bottle by a large depressed deformation at the central portion of the shaped panel wall. However, the negative pressure deformation of this shaped panel wall detracts from the external appearance of the bottle, which lowers the aesthetic appearance and style of the bottle as a consumer good.

Moreover, the shaped panel wall occupying a large surface area at each flat wall of the body is liable to deform. So, when grasping the bottle by the hand, the deformed panel wall where finger tips contact is easily deformed, and the bottle becomes unstable to handle by hand.

Furthermore, as described above, the shaped panel wall occupies a large surface area of each flat wall of the body, but the wall structure of this shaped panel wall is mainly a deformable flat structure. Thus, the bottle's external appearance becomes simple, which also makes the external appearance of the bottle dull.

As stated above, the concave and convex shaped panel wall is molded at the flat wall portion of the body of a PET large square bottle, so that it is extremely difficult to print a commercial name or a company name or to stick and display a label. Hence, the commercial name or the company name is displayed with the aid of a shrunk label made of a heat-shrinkable sheet.

Since this shrunk label is originally a simple sheet, it is easy to print patterns and to form the label onto a cylindrical body. It is further advantageous to strongly attach a label to the bottle by simple but secure heat treatment. However, because of certain shrinking deformation of a heat-shrinkable sheet, the portion opposed to the flat wall of the square tube has large shrinkage as compared with the portion opposed to the ridge-line. As a result, the end of a shrunk label wound around the bottle is wrinkled which deteriorates the external appearance and style of the goods.

When the shoulder portion extension is not sufficient as compared with the square tubular body, a large difference of extension is generated between the ridge line of the shoulder and the flat wall portion, resulting in incorrect thermal deformation at the shoulder portion by this non-uniform extension.

Among numerous characteristics inherent to the above PET bottle, transparency is extremely excellent and effective for increasing visibility of the goods.

Thus, the PET bottle has excellent transparency. As compared with a glass bottle exhibiting the same excellent transparency however, the PET bottle is simply clear and does not exhibit any crystal effect due to deflection of transmitted light, so as to be poor in visual change.

One of the principle reasons why a crystal effect is low in the PET bottle having excellent transparency is because the PET bottle is a biaxially oriented blow molded good, so that its thickness is thin and transmitted light cannot sufficiently be deflected.

It has therefore been considered to make the PET bottle thick to provide a sufficient crystal effect. However, if the PET bottle is made thicker, expensive PET material is increased in the amount required for molding one product, and, as a result, a unit price becomes high, biaxially blow molding techniques become extremely difficult, and sufficient transparency cannot be obtained without biaxially oriented deformation.

SUMMARY OF THE INVENTION

A primary object of the invention is to provide a container exhibiting the function of a groove sidewall of a central circumferential groove and a recess sidewall of a recessed portion as reinforcing rib wall pieces, and to create a self recoverable curved depressed deformation at the time of deformation rather than a sharply bent depressed deformation.

Another object of the invention is to prevent the appearance of reduced pressure deformation which would change the external appearance and shape of the bottle and to prevent deterioration of the external appearance and style of the bottle by attaining reduced pressure compensating deformation of a shaped panel wall for compensating negative pressure generated in the bottle by depressed deformation of the whole shaped panel wall.

A further object of the invention is to increase self configuration retaining capability of the shaped wall itself and to provide an interesting external appearance.

An additional object of the invention is to remove or minimize conspicuous corrugation at the upper edge of a shrunk label by positioning such corrugation in the vicinity of the shoulder portion of the bottle, and to minimize non-uniformity of extension along the circumferential direction at the shoulder portion.

Another object of the invention is to exhibit a satisfactory crystal effect in the PET bottle without increasing the thickness of the PET bottle.

Other objects of the invention become clear from the description and accompanying drawings.

According to a first aspect of the invention, it is possible to obtain a biaxially oriented blow-molded bottle-shaped container made of synthetic resin with the container comprising a rectangular tubular body provided with a central circumferential groove substantially at a center of a vertical length of the rectangular cylindrical body. The central circumferential groove has upper and lower sidewalls being inclined at an oblique angle within a range of 21°–28° with respect to a vertical longitudinal axis of the container.

Moreover, the oblique angle with respect to the bottle center axis of the groove sidewall is measured as an acute angle parallel to the bottle central axis rather than radially from the bottle central axis. So, the oblique angle of the upper groove sidewall and that of the lower groove sidewall are measured from opposite directions.

In the first aspect of the invention, the central circumferential depressed groove is provided at a substantially central portion of the body, so that the wall portion for connecting the upper and lower groove sidewalls and the adjacent flat walls is curbed and projected into the bottle surface. Therefore, the groove sidewalls function to counteract pressure acting on the central circumferential groove portion as a reinforcing rib wall piece, so as to prevent the body wall portion under pressure from simple depressed deformation. When strong pressure force acts to generate a depressed deformation, the junction portion for connecting the groove sidewalls and adjacent flat walls become a projecting deformation for reversing the projection posture.

Even in the bottle viewed from the first aspect of the invention, the junction portion for connecting the center peripheral groove and the adjacent flat walls becomes a projecting deformation in the same manner as the prior bottle. However, in the case of the present invention, the oblique angle of the groove sidewalls is small so that the whole junction portion for connecting the groove sidewalls and the flat walls is curved and deformed as a depression. Thus, the oblique angle of the groove sidewalls and the flat walls is sufficiently reduced by this depressed deformation, and the central portion, which is depressed by a pressing force, is curved outwardly and deformed before the depressed amount becomes large. In the case of an outwardly curved deformation of the junction portion between the groove sidewalls and the flat walls, reverse deformation is generated under the sufficiently reduced condition of the oblique angle of the groove sidewall and the flat wall. This reverse deformation does not become a bent or sharp deformation but rather curved deformation within the range of elastic deformation of the wall. Thereby, positive self restoration to the original is attained when the pressing force disappears.

That is, upper and lower groove sidewalls of the central circumferential groove are set at oblique angles for exhibiting the function of reinforcing rib wall pieces as large as possible within the range of generating no sharply bent reverse deformation. Setting of the oblique angle of the groove sidewall is sought from many experimental examples, and according to the experimental examples, if the oblique angle of the groove sidewall is set at more than about 29°, self configuration sustaining capability becomes large, the whole junction portion between the groove sidewalls and the flat walls when applying pressure becomes hard to cause a rounded depressed deformation, and as a result, depressed deformation at the junction portion becomes a rapid reverse bending and the self configuration sustaining capability cannot be obtained. On the other hand, if the oblique angle of the groove sidewalls is set at less than about 20°, the groove sidewalls cannot sufficiently function as a reinforcing rib wall piece and self configuration sustaining capability is low, so that it is difficult to handle the bottle by grasping by hand.

Moreover, a depressed sidewall of a recessed portion provided at the central portion of the flat walls which form the body acts in the same manner as the groove sidewalls of the central circumferential groove. The bottom wall of such a recessed portion is a shaped panel wall for absorbing reduced pressure deformation, which effectively functions to retain self configuration of the body. However, in the recess sidewalls, the recessed sidewall portion positioned near the central circumferential groove employs an elongated projected curved wall structure, so that it is difficult to form a curved depression. Therefore, in the same manner as the groove sidewalls of the central circumferential groove, the oblique angle of the recess sidewall portion of the recessed portion in the flat walls positioned near the central circumferential groove is set at 28°–21°. Thus, it becomes easy to generate a curved deformation from the groove sidewalls to the flat walls and for the recess sidewall to function as a whole, so as to effectively prevent generation of local sharp reverse deformation.

In the case of positioning the recess sidewall adjacent to the central circumferential groove, the length of the recess sidewall is shorter than that of the groove sidewalls of the central circumferential groove adjacent the flat walls. Therefore, rounded reverse deformation is mainly generated on the side of the groove sidewall, and the recess sidewall is roundly depressedly deformed without any difficulty in reversing the curved deformation of the groove sidewall.

The depth of the central circumferential groove can be made shallow by connecting the upper and lower groove sidewalls of the central circumferential groove by means of a groove bottom wall. However, under certain dimensional limitations, such as a certain groove width of the central circumferential groove, limitation of the oblique angles of the groove sidewalls and the recess sidewall, results in a shallow depth of the central circumferential groove and the recessed portion. Thus the depths of the central circumferential groove and the recessed portion, which form the largest depression in the body can be minimized, so that there is no large difference of extension between each portion of the body, particularly the flat wall, so as to obtain good centrifugal molding of the body and largely reduce generation of local deformation after molding.

According to the second aspect of the invention, there is provided a biaxially oriented blow-molded bottle-shaped container made of synthetic resin, said container comprising a rectangular tubular body including flat walls; each of the flat walls having a central recessed portion having a bottom wall comprising a shaped panel wall for taking up deformation due to reduced pressure in the container, and a shaped peripheral groove invertedly curved around the shaped panel wall; the shaped panel wall having ribs traversing the shaped panel wall in parallel to each other, a crest of each of ribs having a larger radius of curvature than that of a root thereof; and opposite ends of the root being shallow along a large radius of curvature.

Since the shaped panel wall comprises a number of transversal ribs, the shaped panel wall is liable to curve in the vertical direction but hardly curve in the lateral direction by functioning as a reinforcing rib. Moreover, the shaped peripheral groove molded around the shaped panel wall has an inwardly curved wall structure, so that it is easily deformed in the curved direction, that is, the vertical direction with respect to the flat wall surface.

Therefore, when negative pressure is generated in the bottle, the shaped panel wall is largely curved along the vertical direction. Also, the shaped central circumferential groove is curved which depresses and displaces as the whole within the bottle, so as to take up the reduced pressure with sufficient volume.

As mentioned above, the shaped panel wall can be deformed with a large curve in the vertical direction and also depressed or displaced as the whole in order to take up the reduced pressure generated in the container, so that the deformation due to the reduced pressure does not affect the external appearance.

The shaped panel wall has a number of ribs extending transversely. These ribs serve as reinforcing ribs and have a sufficient strength to support urging pressure applied by finger tips and to generate an appropriate friction resistance force between the bottle and finger tips when the bottle is grasped by the hand.

Each rib comprises a crest and root portion and these portions are formed by the curved wall structure, so that their moldability in blow molding is excellent. Each opposite end of the root portion is made gradually shallow along a curve having a large radius of curvature so that the corner portion between the flat walls is improved in moldability.

The ribs thus forming the shaped panel wall provide a number of small concavities and convexities on the surface of the shaped panel wall. Therefore, the shaped panel wall has substantially different wall thickness in any direction owing to the many ribs. Consequently, when the bottle is made of a clear synthetic resin having high transparency such as polyethylene terephthalate, an optical crystal sense occurs in the external appearance of the shaped panel wall by the large variation of wall thickness.

Moreover, when the height of the crest portion is as high as more than three times the radius of curvature of the root portion, the degree of the concave and convex shapes of the shaped panel wall can be made deep. As a result, the self configuration sustaining capability in the transverse direction of the shaped panel wall is improved, and the visible crystal sense is enhanced.

According to the third aspect of the present invention, there is provided a biaxially oriented blow-molded bottle-shaped container made of synthetic resin, the container comprising a rectangular tubular body having an upper end which is a regular polygon having twice as many corners as corners or corner panels on a main portion of the body, and a shoulder having a lower end portion connected to the upper end of the body; and the lower end portion of the shoulder being in the form of a regular polygonal truncated pyramid shape having twice as many corners as corners of the main portion of the body.

A shrunk label is generally applied to the bottle from the upper half portion to the lower end portion of the shoulder. Therefore, the upper edge of the shrunk label applied to the bottle is located at the lower end portion of the shoulder and the opposed lower edge is located in the central circumferential groove.

Thus, the shrunk label is applied around the bottle in such a manner that the upper edge is wound around the reduced lower end portion of the shoulder and the lower edge is also wound around the reduced portion in the central circumferential groove. Therefore, both the upper and lower edges are located in corresponding upper and lower portions of reduced diameters, respectively. Thus, the shrunk label is prevented from drawing away from the bottle and is strongly and stably secured to the bottle.

The lower end portion of the shoulder where the upper edge portion of the shrunk label is wound has a regular polygonal shape and twice as many corners as corner panels of the main portion of the body. Furthermore, the lower end portion has a smaller diameter than that of the main portion of the body. Therefore, the upper edge portion of the shrunk label which is wound around the lower end portion of the shoulder is under a condition that a difference of shrinkage between a portion facing the ridge-line of the lower end portion of the shoulder and a portion facing the flat wall is small. Further, the shrinkage of the portion facing the lower end portion is uniform, and any displacement resulting from the shrinkage of the shrunk label in the vertical direction is prevented by the upper end portion of the body which has the larger diameter. Accordingly, in the upper edge portion of the shrunk label wound around the lower end portion of the shoulder, large wrinkles do not occur.

On the other hand, the central portion of the body where the lower end of the shrunk label is wound has a rectangular tubular shape. Therefore, the lower edge portion of the shrunk label has different shrinkage between a portion facing the ridge-line of the central portion of the body and a portion facing the flat wall. As a result, the lower edge portion of the shrunk label is wrinkled. However, in the present case, the central circumferential groove is provided at the central portion of the body and the lower edge of the shrunk label is located in the central circumferential groove. Accordingly, a portion of the shrunk label at just above the lower edge located in the central circumferential groove is initially applied to the surface of the body and then prevents any displacement of the lower edge portion resulting from the shrinkage of the shrunk label in the vertical direction. Consequently, large wrinkles also do not occur at the lower edge of the shrunk label.

Furthermore, since the lower end portion of the shoulder is molded in the shape of regular polygon, average elongation of each combination of the flat wall and ridge-line portion at the lower end portion of the shoulder is the same. Since the lower end portion of the shoulder has twice as many corners as corner panels of the main portion of the body, the difference of elongation between the flat wall portion and the ridge-line portion is sufficiently small. Accordingly, the lower end portion of the shoulder can be uniformly molded with substantially the same elongation. Since the lower end portion of the shoulder is uniformly elongated in the circumferential direction during blow molding, even if thermal deformation occurs in the shoulder portion due to insufficient elongation, the thermal deformation uniformly occurs in the circumferential direction and therefore irregular deformation does not appear in the external appearance of the shoulder portion due to the thermal deformation.

According to the fourth aspect of the present invention, there is provided a biaxially oriented blow-molded bottle-shaped container made of synthetic resin having a high clarity, the said container including two sets of wall surface portions of first wall surfaces and second wall surfaces which are formed at the shoulder and the bottom, respectively, and are connected through curved lines to each other. A connecting edge of the first wall surface connected to the second wall surface is slightly extended toward the second wall surface. The extended edge of the first wall surface is connected to a connecting edge of the second wall surface through a ridge-line portion which is inwardly curved with a small radius of curvature.

The first wall surface and the second wall surface which are connected at the ridge-line wall portion, are not specified in respect to individual wall structure and a combination of mutual wall structures, but at least one of the wall surfaces is preferably a flat wall surface structure. Particularly, the first wall surface may be a flat wall structure and the second wall surface may be a curved wall structure.

Since the connecting edge of the first wall surface is slightly extended and this extended edge of the first wall surface is connected to the connecting edge of the second wall surface at the ridge-line wall portion, the curved line, i.e., ridge-line portion formed between both the wall surfaces, forms a protruded ridge-line which protrudes in the direction of the extended connecting edge of the first wall surface.

The protruded ridge-line portion is more sharply protruding than that of the usual ridge-line portion to thereby enhance the difference of the refraction direction of the transmitted light through each of the wall surfaces which have different angles of inclination starting from the protruded ridge-line.

Furthermore, the ridge-line wall portion of the protruded ridge-line is inward with a small radius of curvature to locate it in an attitude substantially standing to the transmitted light passing in the direction of thickness of both of the wall surfaces. Thereby, the ridge-line wall portion provides a locally thickened wall portion for the transmitted light by the ridge-line wall portion. It will be seen from the above that since the ridge-line wall portion provides a locally thickened wall portion for the transmitted light, the transmitted light passing through the ridge-line wall portion is subjected to greater refraction than that of transmitted light passing through the adjacent other portion, i.e., both the wall surface portions.

If one of the adjacent wall surface portions is the flat wall structure, particularly if the first wall surface is the flat wall structure and the second wall surface is the curved wall structure, the amount of extension of the protruding ridge-line can be increased within a narrow range to thereby provide a relatively strong refracting action for the transmitted light. Further, the radius of curvature of the inward curve of the ridge-line wall portion can be slightly increased, thereby causing the bottle to be easily molded.

DESCRIPTION OF THE PREFERRED EMBODIMENTS

In the following, an embodiment of a bottle according to the present invention will be explained with reference to the drawings.

Figure 2:
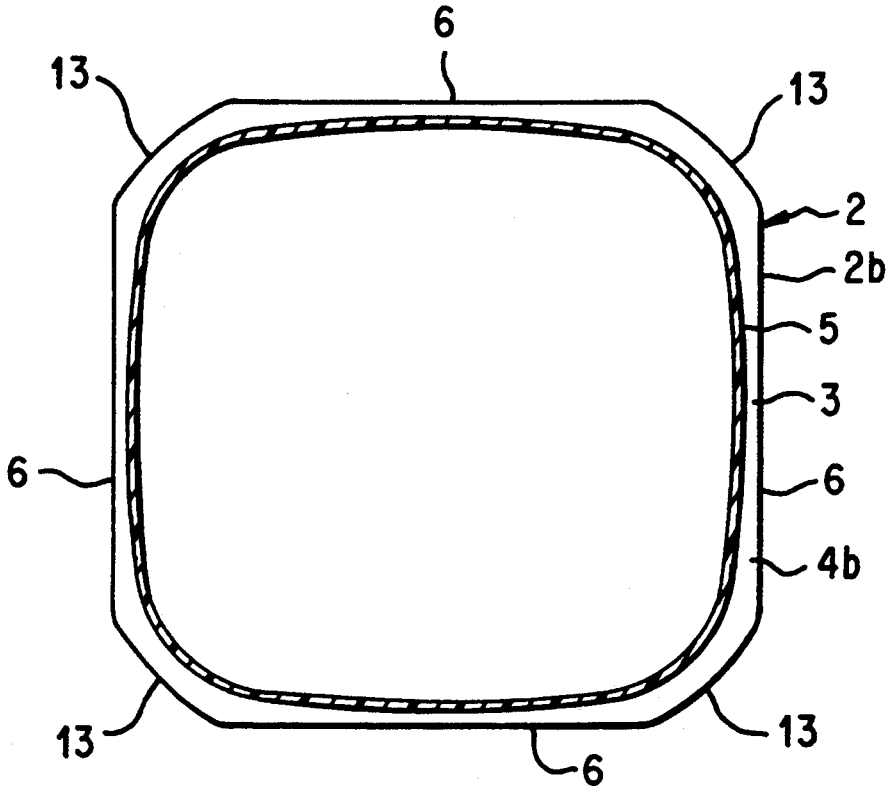
FIG. 2 is a cross sectional view taken on line II—II of FIG. 1.

Referring to an embodiment shown in the drawings, a bottle 1 has a longitudinal axis A—A and a body 2 formed in the form of a square tube. The body has four ridged-line walls 13 at corners thereof, respectively, each corner wall formed by arched ridge-line wall 13 as shown in FIG. 2. The body has also a generally central circumferential groove 3 which is formed at a central position slightly higher than half of the whole height to divide each of four flat walls 6 into upper and lower portions 2*a* and 2*b*, respectively. The body further has a bottom 2*c* having a central curved recess retracted inwardly into the bottle 1 and an upper end portion 2*d* having a diameter which is gradually reduced from a shoulder 11 having a semispherical shape and has an opening 12 at the upper end thereof.

Each of the upper and lower portions 2*a* and 2*b* of the flat wall 6 divided by the circumferential groove 3 has a recessed portion 7*a* and 7*b* formed at a central portion thereof. Each recessed portion 7*a* and 7*b* has a shaped bottom panel wall 8 at the central portion thereof and a deformed sidewall 9 at the peripheral portion thereof.

A portion of the sidewall 9*b* of the recessed portion 7*b* adjacent to the circumferential groove 3 that is the upper portion 92 of the sidewall 9*b* in the lower recessed portion 7*b* and the lower portion 91 of the side wall 9*a* in the upper recessed portion 7*a* extend approximately straight along the circumferential groove 3 so that the portions of the flat wall 6 between the circumferential groove 3 and the recessed portions 7*a* and 7*b* can be easily bent as a whole.

Figure 1:
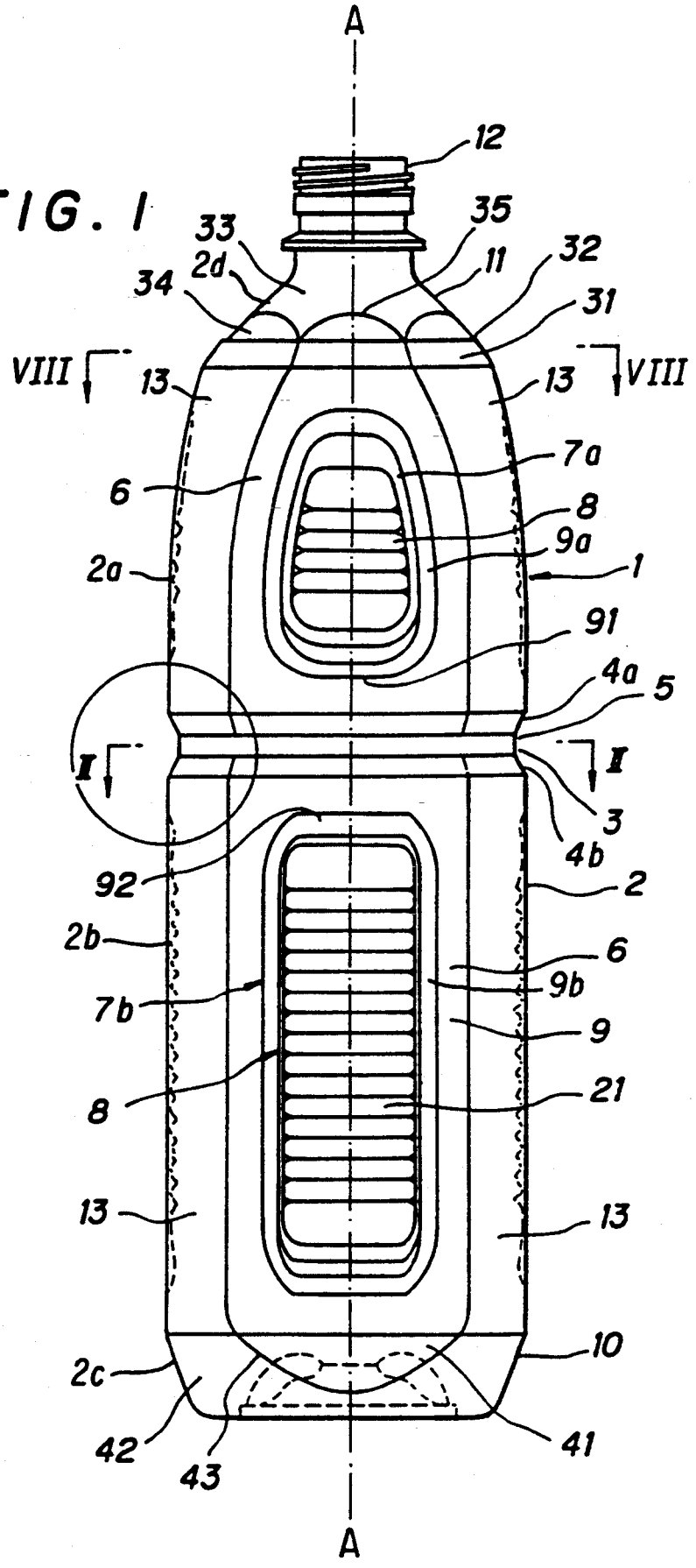
FIG. 1 is a front view illustrating a bottle according to the present invention.

The circumferential groove 3 as shown in FIG. 1 has a flat bottom wall 5 and corners having a large radius of curvature in the cross section thereof as shown in FIG. 2 so that the circumferential groove 3 has smaller depth at a portion opposed to the flat wall 6 than that at a portion opposed to the ridge-line wall 13. As a result, the portion opposed to the ridge-line wall 13 of the circumferential groove 3 is hardly deformed, while the portion opposed to the flat wall 6 is easily bent or depressed. Therefore, when portions of the circumferential groove 3 and the flat wall 6 are bent or deformed by depressing, the ridge-line walls 13 act as strong supporting portions so that the deformation of the groove and the flat wall is effected in a stable mode.

Figure 3:
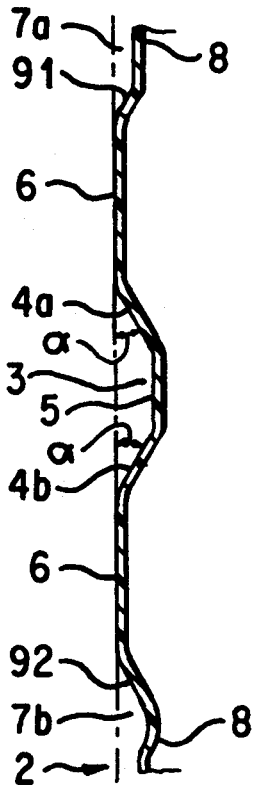
FIG. 3 is an enlarged vertical sectional view of a portion enclosed by a circle in FIG. 1.
Figure 4:
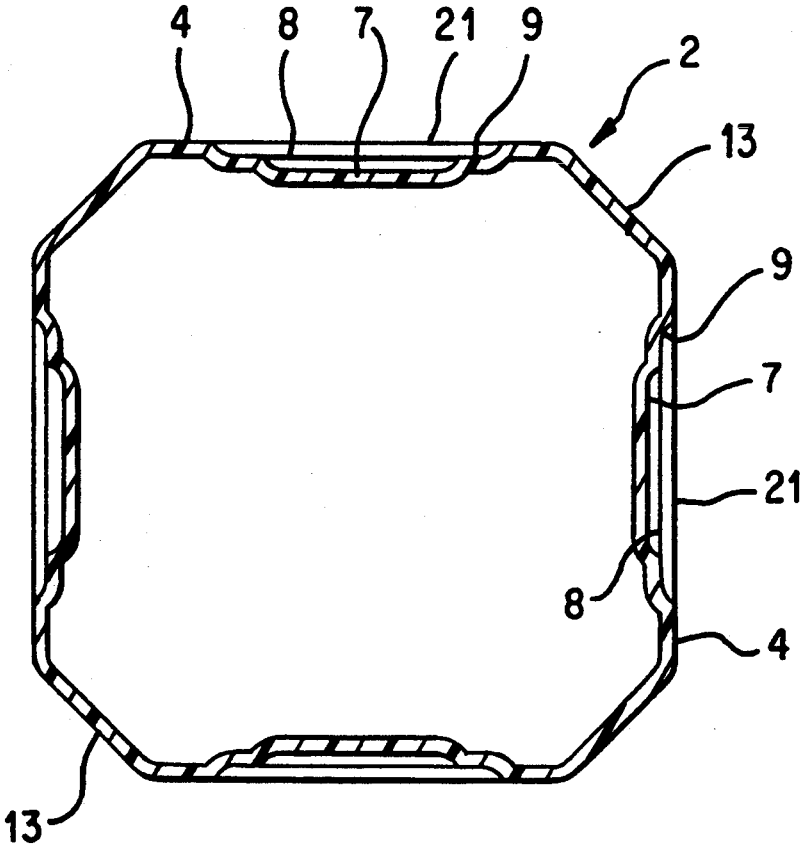
FIG. 4 is a cross sectional view of a body of the bottle shown in FIG. 1.
Figure 5:
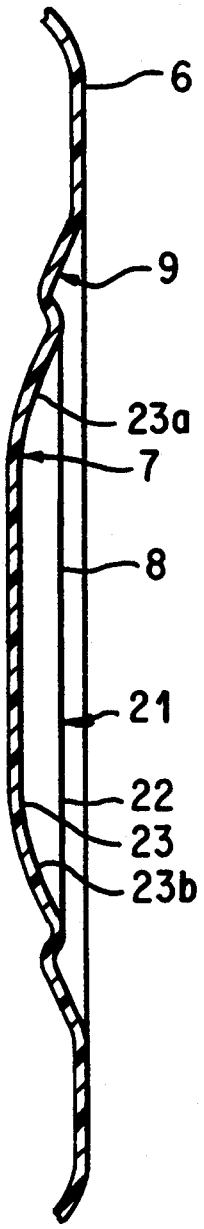
FIG. 5 is a partial enlarged cross sectional view of a flat wall of the bottle shown in FIG. 1.

FIG. 3 illustrates an embodiment of a wall structure near the circumferential groove 3 in vertical section. A bottle 1 including such a wall structure has an internal space of 1.5 liter and is shaped such that the volume of the lower body portion 7*b* is larger than that of the upper body portion 7*a* positioned above the circumferential groove 3. In such a wall structure, since the lower side wall 4b of the circumferential groove 3 is mainly subjected to a depressing force by grasping when the bottle is handled, the lower side wall 4b of the circumferential groove 3 is set at a maximum angle $\alpha$ of inclination of 27°, while the upper side wall 4*a* of the circumferential groove 3 is set at an angle $\alpha$ of inclination of 24° and the angle $\alpha$ of inclination of the sidewall 91, 92 of the recessed portions 7*a* and 7*b*, respectively, opposed to the circumferential groove 3 is set at an angle $\alpha$ of 21°.

The angle of inclination of the groove sidewalls 4*a* and 4b and the recess sidewall 91, 92 and their combination may be selectively set in a range of 21°–27°, but since the purpose of providing the circumferential groove 3 is to enhance the angle of inclination of the lower groove side wall 4b which is subjected to the depression force upon handling of the bottle 1 may be set at the maximum to enhance the self configuration sustaining capability of the body 2 owing to the circumferential groove 3.

It has been found from results of many experiments that when all of the groove sidewalls 4*a* and 4b and the recess sidewalls 91, 92 are set at an angle of inclination of 27°, a higher self configuration sustaining capability than that of the embodiment shown in FIG. 3 is obtainable, but a mode of a self returning operation from a sharp inward deformation is not smooth and particularly such a tendency is remarkably enhanced as the angle of inclination of the lower sidewall 4*b* of the circumferential groove 3 is set at a larger angle. It is been proven to be advantageous from the results of experiments to set the angle of inclination of the recess sidewalls 9 small.

Figure 6:
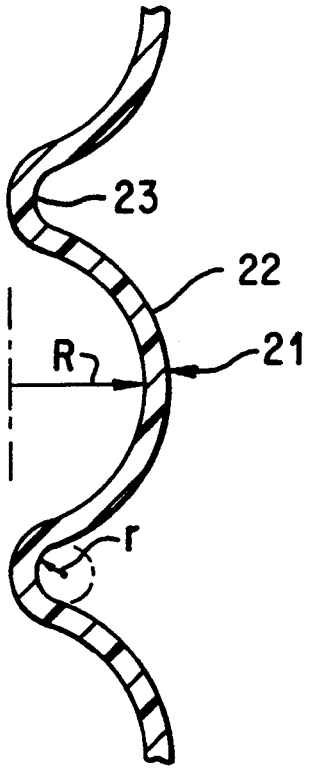
FIG. 6 is a partial enlarged vertical sectional view illustrating a rib on a modified panel wall.

According to the second aspect of the present invention, a number of ribs 21 extending parallel to each other are transversely formed on the shaped panel wall 8 as shown in FIG. 6. These ribs 21 define crests 22 and roots 23, and the radius of curvature R of the crest 22 is set to four times the radius of curvature r of the root 23 to thereby enhance moldability of each of ribs 21.

The ridge-line of the crest of each of ribs 21 is set to the same height as that of the inner peripheral edge of the deformed peripheral groove 9 of each recessed portion 7*a* and 7*b* so as to connect the opposite ends of the rib to the inner peripheral edges of the deformed peripheral groove 9 directly, respectively. The opposite ends of the root 23 become gradually shallow along a curve having a large radius of curvature to connect to the inner peripheral edges of the deformed peripheral groove 9, respectively. Thus, the opposite ends 23*a* and 23*b* of the root 23 are formed gradually shallow along a curve of a large radius of curvature, so that it is capable of enhancing the moldability of the ridge-line wall 13 which is continuously elongated after the flat wall 6 has been deformed during the blow molding of the bottle.

Figure 7:
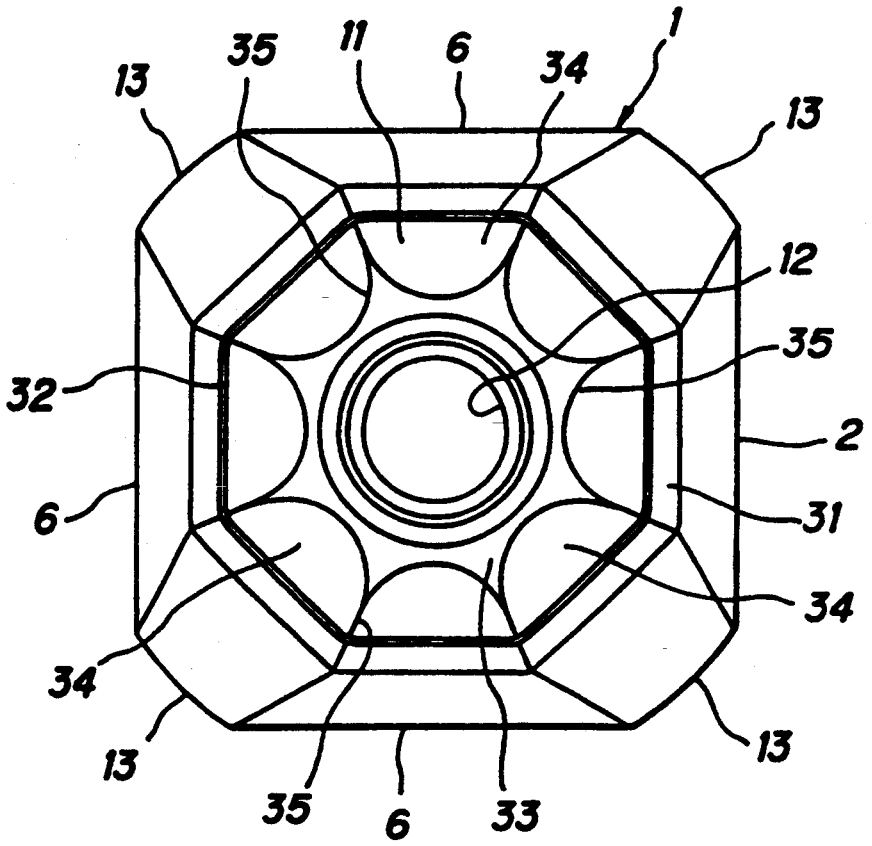
FIG. 7 is a plan view of the bottle shown in FIG. 1.
Figure 8:
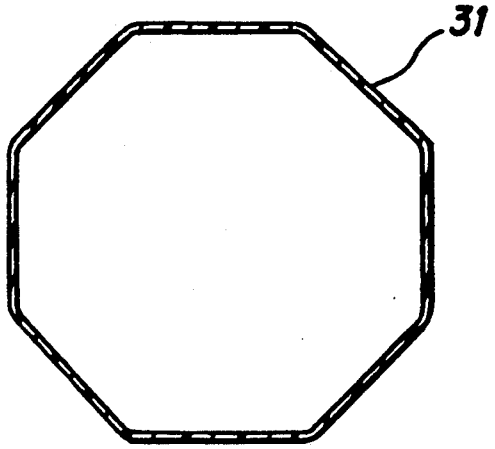
FIG. 8 is a cross sectional view taken on line VIII—VIII of FIG. 1.

According to the third aspect of the present invention, the upper end portion of the bottle body shown in FIG. 7 is preferably shaped as a regular polygon having two times as many corner walls as that of the main portion of the body by forming the ridge-line walls at the corners of the upper end portion of the body as arched shaped walls 34 to thereby provide a regular polygonal tubular shape by the flat walls and the ridge-line walls and then gradually reducing the diameter of the upper end portion of the body to decrease the width of the flat walls and increase the width of the ridge-line walls. As shown in FIG. 7, this embodiment has four side walls 6, with corner walls 13, and eight side walls 34 forming the upper end portion. In the embodiment shown in the drawings, the diameter of the upper end portion of the body 2 is gradually reduced to decrease the width of the flat walls 6 and increase the width of the ridge-line walls 7 to thereby shape the upper end portion of the body as a regular octagon. It is desirable in view of external appearance and molding that the body is molded in a square tubular shape.

The lower end portion 31 of the shoulder 11 continued to the upper end of the regular octagonal portion of the body 2 has a shape of a low regular octagonal truncated pyramid extended directly from the upper end of the body 2. The upper end of the lower end portion 31 is continued to a main portion 33 in the form of a semi-spherical shell as a remainder of the shoulder 11 through a narrow stage portion 32. The main portion 33 is provided with an opening 12 at the upper end thereof. The lower end portion of the semi-spherical main portion 33 has inclined flat wall portions 34 continued to the flat walls in the lower end portion 31, respectively, and a scalloped ridge-line 35 formed as a boundary between the inclined flat wall portions 34 and the semi-spherical surface 33.

A shrunk label printed with a display such as a commercial name, contents and the like is applied to the upper half portion 2*a* defined by the circumferential groove 3 of the body 2 with the lower edge of the shrunk label being positioned in the circumferential groove 3 and the upper edge of the label being positioned on the stage portion 32 of the shoulder 11. By positioning the lower edge of the shrunk label in the circumferential groove 3, i.e., on the upper groove surface 4*a* of the circumferential groove 3, the shrunk label is hardly viewed by the external appearance of the bottle. Therefore for example, even if the lower edge of the shrunk label has been slightly wrinkled, the external appearance of the bottle will not be affected by the wrinkle. Similarly, since the upper edge of the shrunk label is located on the stage portion 32, which forms a flat surface along the radial direction, the upper edge of the shrunk label is hardly wrinkled. Moreover, since both the upper and lower edges of the label are located in areas which are sharply reduced in diameter, the shrunk label is very strongly and stably attached to the bottle 1.

A wall structure arranged according to the fourth aspect of the present invention is applied to the shoulder 11 and the bottom portion 10 of the bottle 1. In the case of the shoulder 11 shown in FIG. 7, the main portion 33 of the shoulder constitutes the second wall surface and the flat wall portion 34 constitutes the first wall surface. While, in the case of the bottom 10, as shown in FIGS. 9 and 10, the peripheral wall of the base portion 10 which is the tapered cylindrical wall portion extending upwardly from the bottom comprises the second wall surface 42 and a flat wall surface 41 which is formed by obliquely cutting the upper half portion of the second wall surface 42 continued to the flat wall portion 6 of the body 2.

Figure 9:
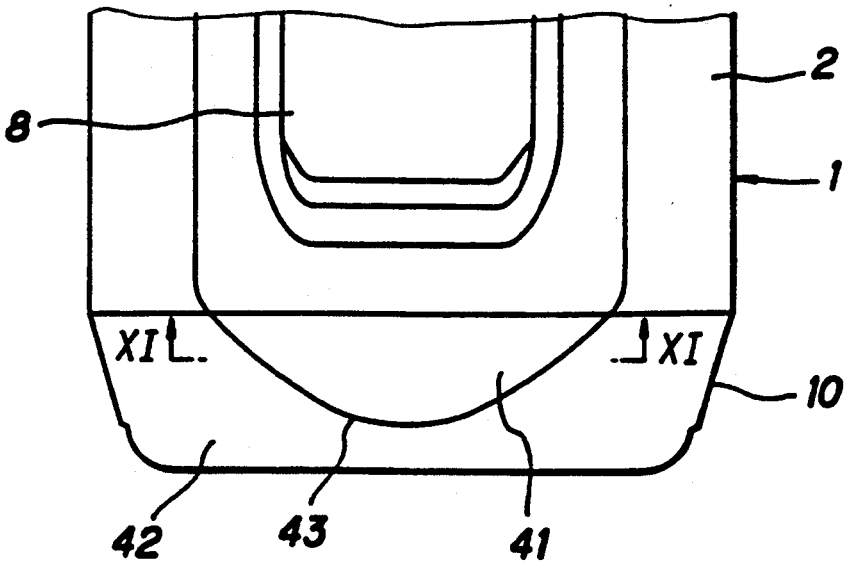
FIG. 9 is an enlarged front view of the bottom portion of the bottle shown in FIG. 1.
Figure 10:
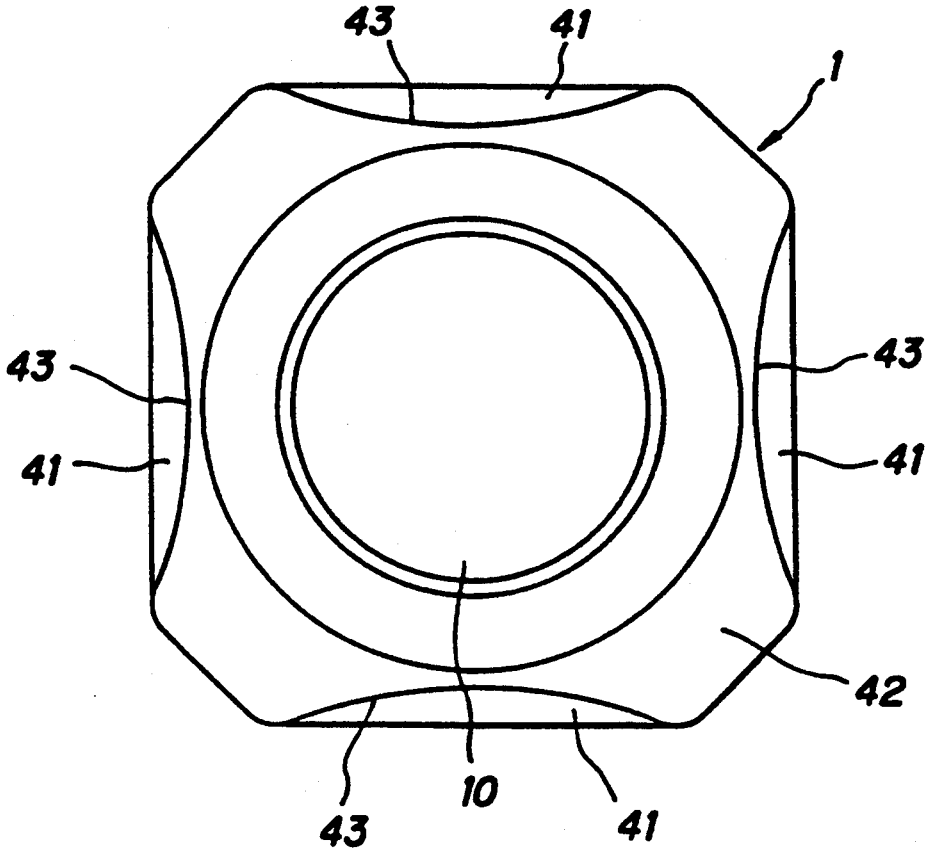
FIG. 10 is a bottom plan view of the bottle shown in FIG. 1.
Figure 11:
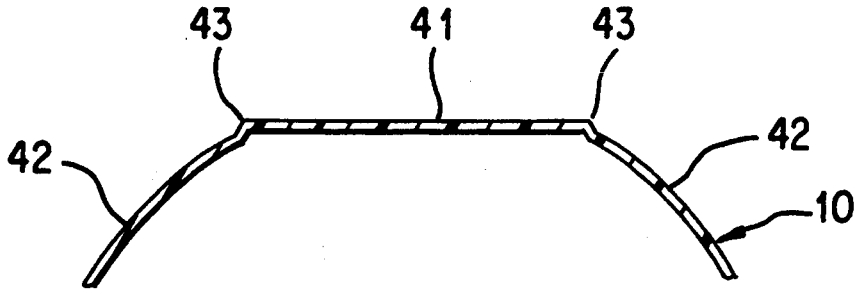
FIG. 11 is a sectional view of a wall taken on line XI—XI of FIG. 9.
Figure 12:
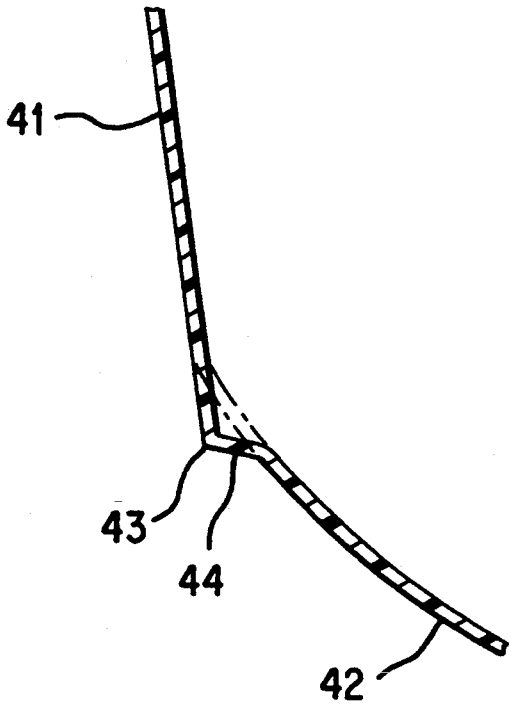
FIG. 12 is an enlarged detail of a protruded ridge-line portion shown in the sectional view of FIG. 11.

An embodiment of the wall structure arranged according to the present invention is illustrated in a sectional view of FIG. 11 which is a section taken on line XI—XI in FIG. 9 illustrating the embodiment of the bottom portion 10. A portion of a protruded ridge-line 43 shown in FIG. 11 is illustrated in FIG. 12 in enlarged scale.

By comparing the portion of the protruded ridge-line 43 of the wall structure according to the present invention shown by a solid line with a prior art wall construction of a ridge-line wall portion shown by a dotted chain line, it is shown that a protruding amount of the protruded ridge-line 43 is greatly larger than that of the prior art ridge-line structure and that the ridge-line wall portion 44 constituting the protruding ridge-line 43 is bent over with a small radius of curvature to locate a portion of the ridge-line wall portion as a standing rib wall.

According to the above arrangement of the present invention, the following effects are obtained.

By controlling the angle of inclination of the groove sidewalls 4*a* and 4*b*, any bent and/or depressed deformations which could not be restored can be perfectly prevented from occurring in the junction between the groove sidewalls 4*a* and 4*b* and the flat wall portion 6, as a result there is no inconvenience of bent and/or depressed permanent deformations.

Since any bent and/or depressed deformation occurring in the junction between the groove sidewalls 4*a* and 4*b* and the flat wall portion 6 is an elastic deformation in all of the range of its deformation, when the bottle is grasped by the hand and consequently bent and/or depressed by a depressing force, the finger tips of the hand applying the depressing force is always counteracted by a rebound so that a stable grasping operation is achieved even if the bent and/or depressed deformation occurs.

By controlling the angle of inclination of the groove sidewalls 4*a* and 4*b* and the recess sidewalls 9 to a relatively small amount, the depth of the circumferential groove 3 and the recessed portions 9 can be made shallow and the degree of concavity and convexity in the body 2 can be made small. Therefore, the amount of elongation in the flat wall portion 6 can be uniformized to provide a bottle having a good moldability and less deformation.

The shaped panel walls 8 can be deformed for taking up the negative pressure by a large bent deformation of the whole shaped panel wall 8 and an inward depressed deformation of the whole shaped panel wall 8. Therefore, such a negative pressure compensating deformation in the recessed portions 9 is not observed in the external appearance of the bottle to thereby prevent degradation of the external appearance caused by the deformation of compensating for negative pressure and reserve the excellent external appearance of the bottle.

The ribs 21 serve as reinforcing ribs to enhance the self configuration sustaining capability in the transverse direction of the modified panel wall portion 8. Accordingly, when the bottle is grasped by hand, the shaped panel wall 8 which is pressure contacted with the finger tips is hardly depressed by the pressure of the finger tips and supports the urging pressure. Therefore, the bottle can be stably grasped by hand and smoothly and stably handled as the whole.

The modified panel wall 8 comprises a number of ribs 21 to form a wall structure having a concave and convex shape with undulations providing a strong optical action to transmitted light. Therefore, the body 2 of the bottle 1 can provide an appearance having a crystal-like decoration effect by optical action, and the external appearance of the bottle can be satisfactorily improved.

When the shrunk label is attached around the body 2 of the bottle, the upper edge of the shrunk label is located on the lower end portion 31 of the shoulder 11 of a regular polygonal tubular shape having twice as many corner walls as in the body, shown as walls 13 and 34. As a result, the upper edge of the shrunk label is hardly wrinkled. Therefore, the external appearance of the bottle is not negatively impacted by wrinkles in the edge of the shrunk label.

The upper edge of the shrunk label is located on the lower end portion of the shoulder 11 having a reduced diameter and the lower edge is located in the circumferential groove 3 having a reduced diameter. Therefore, the shrunk label can be strongly and stably attached to the body with simple shrinkage.

Since the lower end portion 31 of the shoulder is formed in the shape of a regular polygonal truncated pyramid, the elongation along the circumferential direction is substantially uniformly achieved. Therefore, even if the shoulder 11 is thermally deformed, this thermal deformation occurs uniformly over the shoulder 11, and there is no strain causing degradation of the external appearance of the shoulder.

In the bottom 10 of the bottle 1, the ridge-line 43 at the boundary between the flat wall surface 41 and the second wall surface 42 can be greatly protruded. Then, the corner formed by thus protruded ridge-line 43 can be sharply observed. Therefore, any difference of degree of refraction of transmitted light between both the wall surface portions is emphasized and then the crystal effect is enhanced.

A part of the ridge-line wall portion 44 where the ridge-line is curved over can be located in the form of a ribbed wall piece standing with respect to both the wall surface portions to provide a thicker portion to the transmitted light and thereby sufficiently refracting the transmitted light. Consequently,, the ridge-line wall portion can give a more remarkable crystal effect.

The protruded ridge-line 43 slightly extends the connecting edge of the flat wall surface 41. The thus extended connecting edge is only connected to the connecting edge of the second wall surface 42 at the curved over ridge-line wall portion 44. Accordingly, the bottle 1 can be easily and accurately molded in the conventional molding operation independent of whether a new or existing molding die is used.

What is claimed is:

1. A biaxially oriented blow-molded bottle-shaped container made of synthetic resin comprising:

a body having a vertical longitudinal axis provided with a circumferential groove substantially at a central portion of a vertical length of the body, wherein the circumferential groove has upper and lower sidewalls inclined at an oblique angle within a range of 21°–28° with respect to the vertical longitudinal axis of the container.

2. The container according to claim 1, wherein the circumferential groove has a flat groove bottom wall disposed between the sidewalls.

3. The container according to claim 2, wherein the groove sidewalls are inwardly inclined toward the groove bottom wall at an angle of about 27° with respect to the vertical longitudinal axis.

4. The container according to claim 1, wherein the body has a plurality of flat walls divided into upper and lower sides by the circumferential groove, each of the flat walls having a central recessed portion with a bottom wall comprising a shaped panel wall formed to compensate for deformation due to reduced pressure in the container and the recessed portion has a recessed sidewall adjacent the shaped panel wall at a side near the groove sidewalls inclined at an oblique angle within a range of 21°–28° with respect to the vertical longitudinal axis of the container.

5. The container according to claim 4, wherein the recessed sidewall of each recessed portion extends annularly around the respective recessed portion.

6. The container according to claim 4, wherein the recessed sidewall of each recessed portion is inclined at about 21° with respect to the vertical longitudinal axis of the container.

7. A biaxially oriented blow-molded bottle-shaped container made of synthetic resin, comprising:

a body including flat walls, each of the flat walls having a central recessed portion having a bottom wall comprising a shaped panel wall for compensating deformation due to reduced pressure in the container, and a shaped peripheral groove curved around the shaped panel wall, wherein the shaped panel wall has ribs each with a curved crest and a curved root traversing the shaped panel wall in parallel to each other, the crest of each of the ribs having larger radius of curvature than that of the root.

8. The container according to claim 7, wherein the radius of curvature of the crest of each of the ribs is at least three times as long as the radius of curvature of the root.

9. The container according to claim 7, wherein each rib has opposed ends and extends across the respective shaped panel wall, one end adjacent a portion of the shaped peripheral groove and the other end adjacent an opposed portion of the shaped peripheral groove, the opposite ends of the root being curved inwardly and joining the shaped peripheral groove along a large radius of curvature.

10. The container according to claim 7, wherein the shaped peripheral groove is concave with respect to the flat walls.

11. The container according to claim 10, wherein each shaped peripheral groove is inclined from the flat wall at an angle in the range of 21°–28° measured from a vertical axis of the container.

12. The container according to claim 7, further comprising a generally central circumferential groove having sidewalls inwardly inclined at an angle from the flat walls in the range of 21°–28° measured from a vertical axis of the container.

13. A biaxially oriented blow-molded bottle-shaped container made of synthetic resin, comprising:

a rectangular tubular body having a main portion with four corner walls and an upper end which is a regular polygon having eight corner walls and a shoulder having a lower end portion connected to the upper end of the body, the lower end portion of the shoulder being in the form of a regular polygonal truncated pyramid shape having eight corner walls.

14. The container claimed in claim 13, wherein the corner walls of the upper end portion of the body comprise four substantially flat ridge-line walls and four intermediate flat walls each disposed between a pair of ridge-line walls to form a regular polygonal tubular shape, wherein the upper end portion is gradually reduced in diameter to decrease a width of each of the intermediate flat walls and to increase a width of each of the ridge-line [wall]walls to form the regular polygon.

15. The container according to claim 13, wherein the shoulder has an upper end portion which is a semispherical shell portion and the lower end portion of the shoulder is connected to the semispherical shell portion of the shoulder through a narrow stage portion, and a portion of the semispherical shell portion opposed to each flat wall adjacent the lower end portion of the shoulder has inclined flat wall portions.

16. The container according to claim 13, wherein the body has a circumferential groove which is depressed in a substantially central portion of the body.

17. The container according to claim 13, wherein the body has a square tubular shape.

18. The container according to claim 13, wherein the body has a plurality of shallow recessed portions.

19. A biaxially oriented blow-molded bottle-shaped container made of synthetic resin having a high clarity, comprising a body, a shoulder and a bottom and including two sets of first wall surface portions and second wall surface portions, each set formed at the shoulder and the bottom, respectively, and each first wall surface portion connected to a second wall surface portion through a curved edge, wherein the curved connecting edge of each first wall surface portion connected to each second wall surface portion extends toward the second wall surface portion and includes a ridge-line wall portion which is inwardly curved with a small radius of curvature.

20. The container according to claim 14, wherein the first wall surface portion is a flat wall structure, and the second wall surface portion is a curved wall structure.

21. The container according to claim 1, wherein the body has a plurality of flat walls and each first wall surface portion is coupled to a flat wall and extends therefrom.

22. The container according to claim 21, wherein each flat wall has a central recessed portion therein.

23. A container formed of biaxially oriented blow-molded synthetic resin and having a vertical axis, comprising:

a tubular body having flat sides;

a plurality of corners connected between the flat sides;

a shoulder connected to an upper part of the body; and a bottom connected to a lower part of the body, wherein the body has a circumferential groove therein with inclined sides and a groove bottom, the groove sides being inclined at an angle in the range of 21°–28° measured from the vertical axis, and has a plurality of recessed portions with inclined sides and a textured panel bottom, the recessed portion sides being inclined at an angle in the range of 21°–28° measured from the vertical axis, wherein the shoulder has a plurality of flat wall portions, each flat wall portion corresponding to one of one of the flat sides and one of the corners of the body, and wherein the bottom connected to the lower part of the body has first and second surfaces, each first surface extending from one of the flat sides of the body and each second surface being connected to a first surface by a ridge-line.

* * * * *

UNITED STATES PATENT AND TRADEMARK OFFICE

CERTIFICATE OF CORRECTION

PATENT NO. : 5,381,910

DATED : January 17, 1995

INVENTOR(S) : Hiroaki SUGIURA, Toshio YAKA

It is certified that error appears in the above-indentified patent and that said Letters Patent is hereby corrected as shown below:

ON THE TITLE PAGE

[86], §371 Date: change "Jul. 10, 1990" to --May 11, 1992--;

§102(e) Date: change "Jul. 10, 1990" to --May 11, 1992--.

Add --[30] Foreign Application Priority Date Jul. 10, 1989
[JP] Japan .....1-80903--.

Signed and Sealed this

Twenty-third Day of May, 1995

Bruce Lehman

*Attest:*

BRUCE LEHMAN

*Attesting Officer*

*Commissioner of Patents and Trademarks*